US010448708B2

(12) United States Patent
Mercalli

(10) Patent No.: US 10,448,708 B2
(45) Date of Patent: Oct. 22, 2019

(54) METHOD, DEVICE AND MACHINE FOR PROCESSING SHOES

(71) Applicant: LEA S.R.L., Milan (IT)

(72) Inventor: Luciano Mercalli, Vigevano (IT)

(73) Assignee: LEA S.R.L., Milan (IT)

( * ) Notice: Subject to any disclaimer, the term of this patent is extended or adjusted under 35 U.S.C. 154(b) by 96 days.

(21) Appl. No.: 15/429,684

(22) Filed: Feb. 10, 2017

(65) Prior Publication Data

US 2017/0231329 A1 Aug. 17, 2017

(30) Foreign Application Priority Data

Feb. 16, 2016 (IT) ..... 102016000015607

(51) Int. Cl.
*A43D 37/00* (2006.01)
*A43D 25/18* (2006.01)
*A43D 95/22* (2006.01)

(52) U.S. Cl.
CPC ..... *A43D 37/00* (2013.01); *A43D 25/18* (2013.01); *A43D 25/181* (2013.01); *A43D 25/183* (2013.01); *A43D 95/22* (2013.01); *A43D 2200/10* (2013.01)

(58) Field of Classification Search
CPC ..... A43D 37/00; A43D 25/18; A43D 25/181; A43D 25/183; A43D 95/22
USPC ..... 12/73.5, 77, 77.5, 79.3, 79.2
See application file for complete search history.

(56) References Cited

U.S. PATENT DOCUMENTS 1,912,555 A 6/1933 Weinstat et al.
1,959,605 A * 5/1934 Wedger ..... A43D 25/181 12/142 F
2,068,141 A * 1/1937 Kramer ..... A43D 25/181 118/262
2,110,157 A * 3/1938 Jorgensen ..... A43D 25/181 118/228
2,736,045 A * 2/1956 Kamborian ..... A43D 25/053 118/410
3,331,147 A * 7/1967 Isaacson ..... A43D 89/00 12/142 R
3,783,463 A * 1/1974 Von Schoppe ..... A43D 25/18 12/123
4,951,338 A * 8/1990 Brown ..... A43D 25/183 12/77

(Continued)

FOREIGN PATENT DOCUMENTS

EP 0388674 A2 9/1990
EP 0992200 A1 4/2000

(Continued)

OTHER PUBLICATIONS

Italian Search Report dated Oct. 4, 2016, of Application No. ITUB20160801.

*Primary Examiner* — Ted Kavanaugh

(74) *Attorney, Agent, or Firm* — Perkins Coie LLP; Viola T. Kung

(57) ABSTRACT

A method for preparation of a part of a surface of a shoe for subsequent gluing comprises the steps of spreading a glue on the operating surface of a roughing tool and applying this operating surface onto the part of the shoe to be roughed before drying of the glue, so as to transfer the glue onto the part of the surface being roughed. A device (14) implementing this method and a machine (10) using this device are also described.

9 Claims, 4 Drawing Sheets

(56) References Cited

U.S. PATENT DOCUMENTS 4,970,745 A * 11/1990 Davies ..... A43D 37/00
12/14.2

FOREIGN PATENT DOCUMENTS

| | | | |
|---|---|---|---|
| EP | 1139809 | A1 | 10/2001 |
| EP | 1281330 | A1 | 2/2003 |
| IT | 1326889 | | 12/2001 |

* cited by examiner

METHOD, DEVICE AND MACHINE FOR PROCESSING SHOES

This application claims the priority of Italian Application No. 102016000015607, filed Feb. 16, 2016.

FIELD OF THE INVENTION

The present invention relates to a method, a machine and a device for roughing parts of a shoe and for applying glue onto these parts.

DESCRIPTION

Figure 1:
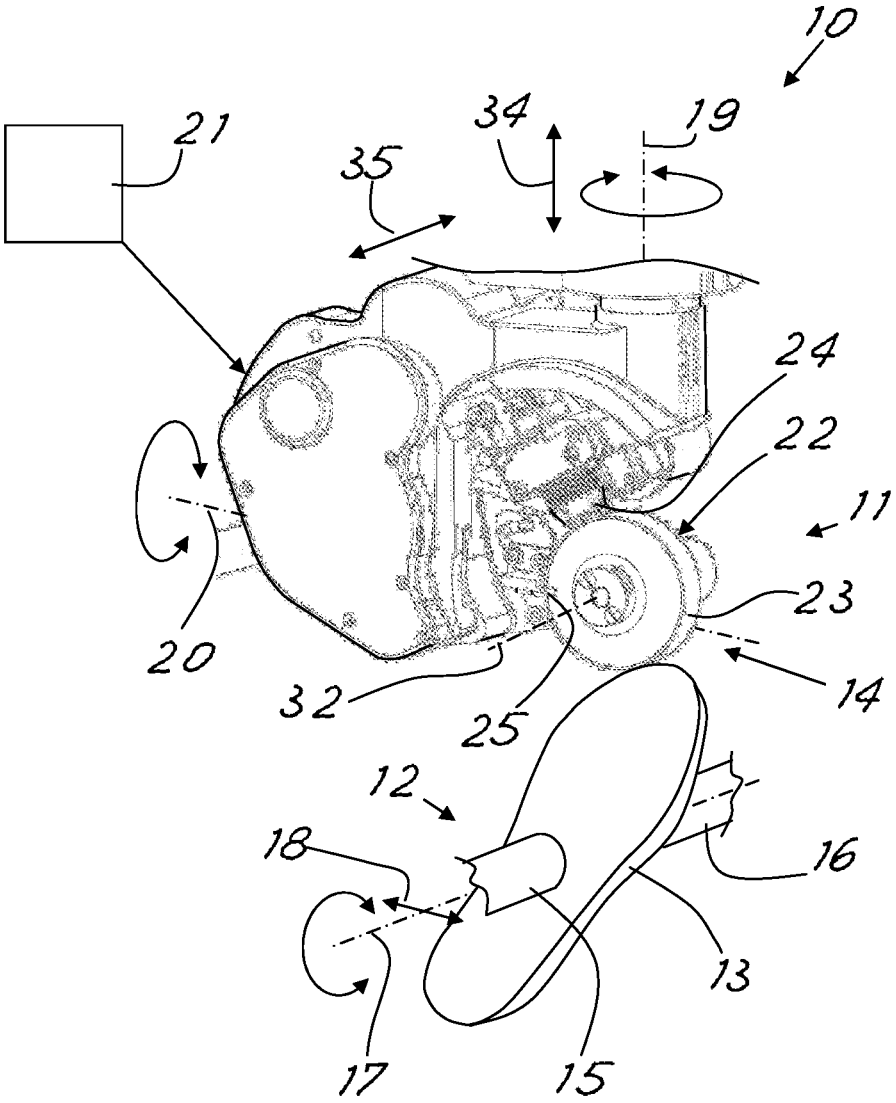
FIG. 1 shows a schematic partial perspective view of a machine applying the principles of the present invention.

During the production of shoes it is known that there is the problem of having to rough firstly the surfaces to be glued, in order to improve the adhesive grip of said gluing. This means that the shoes must undergo two successive processing steps which, however, must generally be perfectly combined on the shoe to avoid poor gluing or visible defects at the end of the shoe processing operation.

In particular, the invention may be advantageously used for shoe processing steps which require roughing of the side edge of the shoe close to the bottom and the application of glue on the said roughed part for the subsequent fixing of soles with side edges.

These steps are of particular importance in many types of shoes such as sport shoes, sneakers, mountain boots, military boots, working footwear and, generally speaking, all those shoes where the sole covers not just the bottom of the shoe but also the side thereof and is glued thereto.

This represents a very large and rapidly expanding market since sneakers are increasingly being worn instead of conventional shoes for day-to-day use.

During gluing of the side edges, both the roughing and the subsequent glue application operation must be performed with precision within—and not outside of—the area which will be covered by the sole, so as to avoid visible defects on the side of the assembled shoe, but without leaving zones which have not been roughed or glued.

To date, this particular processing step is therefore performed in most cases manually, even in those situations where a high productivity is required, for example the manufacture of sports shoes, and requires great precision and ability on the part of the person performing this step.

Normally, the manual steps of roughing and glue application therefore consist of three separate operations:

1) The shoe is firstly placed on a sole of corresponding size (or in some cases even using the sole which must then be mounted on that specific shoe). The assembly is then positioned in turn on a special station which rotates about its central axis. During rotation an operator marks on the shoe the profile of the edge of the sole, which will represent the limit of the area to be roughed.

2) The shoe proceeds along the production line and is taken up by a second operator who carries out the roughing operation on it using a special tool provided with a small milling cutter, namely removes the surface layer of leather or synthetic material. This operation must be necessarily carried out since it ensures optimum penetration of the glue and consequently sufficiently strong gluing. It is clear that the operation must be performed with great precision since the roughing line must not lie outside the line of the sole marked previously. This requires, as already mentioned, a great deal of manual skill on the part of the operator who must be able to maintain the same working quality during the whole of the working day. Otherwise, obviously, this will have a negative impact on the production quality and the number of rejects (a shoe with roughing beyond the edge of the sole and therefore visible is certainly not acceptable from a quality point of view).

3) The shoe then reaches a gluing station, where the operator, by means of a small brush, soft brush or similar tool spreads the glue on the roughed part. Depending on the type of shoe, the materials used and the glue, this operation must be carried out once or several times in succession. Obviously the same considerations mentioned in respect of point 2) above with regard to the necessary precision and difficulty of the operation are also applicable here. On occasions adhesive masking tape is even used to define the limits of the gluing area; obviously the application and removal of the tape results in lengthening of the operation time and consequently an increase in the cost thereof. Furthermore, if the glue spreads outside of the limits of the roughing zone, it will be visible once the shoe has been completed, while, on the other hand, if the glue does not cover all of the correctly roughed zone, there will be zones of the sole which do not adhere fully to the shoe. This is particularly visible along the top edges of the sole on the sides of the shoe.

In an attempt to automate at least partially the procedure, in the prior art various solutions have been proposed, such as those which envisage the use of roughing machines and lateral gluing devices and/or roughing and gluing robots.

However, hitherto the machines available on the market manage only partly to overcome the aforementioned problems.

Among other things, the slight imperfections of the assembled shoe, the use of natural materials which may have different thicknesses depending on the sample used and the differences between soles (which cannot be entirely eliminated during the associated production processes, even where more closely controlled) make automation of this processing operation and perfect reproducibility of the result extremely difficult to achieve.

For example, the patent CERIM EP1139809 proposes a roughing machine for the side edge of the shoe which is computerized so as to follow with six movement axes the entire side edge of the shoe by means of a rotating roughing head. The problem, however, of subsequent gluing of the roughed zone is not solved.

Italian patent Cerim IT1326889 describes a device for positioning and fixing the form in shoe-making machines which overcomes the problem of variability of the thickness of the leather in the assembled shoe. However, it is unable to eliminate definitely any imperfections during the subsequent gluing steps, should they be performed by different machines.

EP0992200, again in the name of CERIM, describes an automatic machine with two processing stations, one for roughing and the other one for application of glue. The machine is, however, suitable only for gluing the bottom of the shoe (where less precision during gluing is required), but does not allow gluing of the side edge, such that the aforementioned problems of precision would still exist.

Generally, in fact, while a roughing tool has a well-defined and stable size and edges and computerized positioning thereof may be precisely adjusted, the glue applicator (of the spray, roller, rotating brush or dispensing nozzle type) by nature has edges which are less well-defined and the glue application zone is consequently less precise. It is thus difficult to ensure the identical range of action of the roughing head and the glue applicator.

In any case the machines available hitherto have a relatively high cost which means that widespread distribution thereof is difficult, in particular in the developing countries, without considering the difficult nature of the operation and the productivity required, which is some cases may even be much more than 1000 pairs of shoes/day. The machines are also specialized in a single operation, so that automation of the entire process requires the use of more than one machine (or machines with a double station as in EP0992200), thus exacerbating the problem of the cost which is in any case not always compensated for by the results which can be obtained.

Both in the case of manual processing and in the case of machine processing, a step for careful cleaning of the shoe is then always needed between the roughing operation and the gluing operation. In fact, the roughing operation produces dust which must be carefully removed from the shoe before application of the glue because this dust deposited on the surface of the shoe would remain trapped between the surface of the shoe on which the glue is to be spread and the glue itself, thus reducing the effectiveness of the glue and the final gluing quality. The cleaning step, however, slows down the processing operation and does not always fully achieve the desired result.

The general objects of the present invention include, among others, singly or in combination, those of overcoming the aforementioned problems of the prior art, providing a method, a device and a machine which are able to perform both the roughing step and the step of precise application of the glue, suitably covering the roughed zones with glue, all of which at a relatively low cost and avoiding also the need to perform two successive steps in two separate machines.

In view of these objects the idea which has occurred is to provide, according to the invention, a method for preparation of a part of a surface of a shoe for subsequent gluing, comprising the steps of spreading a glue on the operating surface of a roughing tool and applying this operating surface onto the part of the shoe to be roughed before drying of the glue, so as to transfer the glue onto the part of the surface being roughed.

Still according to the principles of the invention the idea has also occurred to provide a device for preparation of a part of a surface of a shoe for subsequent gluing, comprising a roughing tool having a roughing operating surface and glue dispensing means able to spread the glue on this operating surface during the operation of roughing said part of the surface of a shoe, so as to transfer the glue onto said part of the surface being roughed.

Still according to the principles of the invention the idea has also occurred to provide a machine for preparation of a part of a surface of a shoe for subsequent gluing, comprising automatic programmed-movement means for moving said device.

In order to illustrate more clearly the innovative principles of the present invention and its advantages compared to the prior art, examples of embodiment applying these principles will be described below with the aid of the accompanying drawings.

With reference to the figures, FIG. 1 shows in schematic form a machine, denoted overall by 10, applying the principles of the invention.

The machine comprises a device according to the invention for preparation of the shoe for subsequent gluing, wherein a roughing tool, advantageously rotating, is spread or infused with glue by means of a dispensing system. The device thus performs the roughing operation on the shoe and at the same time, as a result of the movement and/or rotation of the roughing tool, applies onto the roughed surface a suitable quantity of glue before the glue dries.

The machine 10 is provided with automated means for the programmed movement of the device on the surface of a shoe. Advantageously such a machine comprises preferably a processing head 11 and a support 12 for a shoe 13. The processing head 11 and the support 12 are movable relative to each other by means of drives which allow the processing device, indicated by 14, to follow the desired trajectories on a shoe 13 being processed, so that the operating surface of the tool may suitably follow the entire surface of the shoe on which roughing and gluing must be performed.

The movement structure of the tool and the support are per se substantially known and will not be described or illustrated in detail here. For example six degrees of freedom for relative positioning of the head and support may be provided.

In particular, as schematically shown in FIG. 1, an advantageous structure may be such that the shoe is supported by the support 12 so as to rotate the shoe about an axis 17 perpendicular to the sole of the shoe.

For example, suitable gripping members 15, 16 may be provided, being arranged opposite each other and suitably shaped so as to clamp between them the shoe, gripping it on the bottom and on the opposite side (for example the neck of the form inside the shoe) so as to leave the entire peripheral side edge to be processed free from obstacles.

The gripping members 15, 16 controllably rotate the shoe about the axis 17 so that the tool 22 travels over the entire peripheral surface to be processed around the shoe.

The support 12 may also be controllably displaced in a direction 18 transverse to the axis of rotation 17 so as to move the shoe underneath the head 11.

In turn, the head 11 may have drives for rotating it about a substantially vertical axis 19, so as to incline the tool about a substantially horizontal axis 20, transverse to the axis 17, and for movement along a vertical axis 34 and along a horizontal axis 35 transverse to the direction of movement 18.

Figure 7:
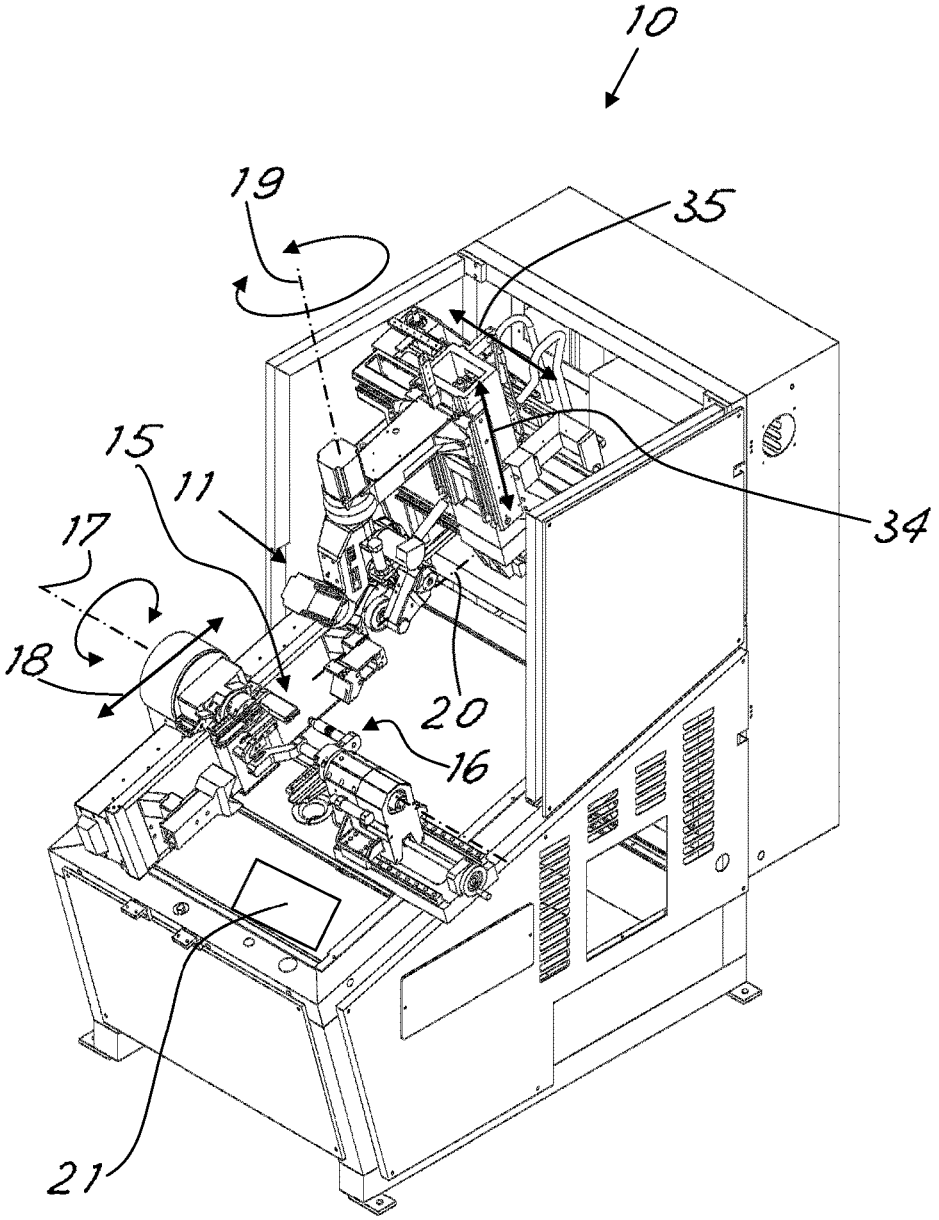
FIG. 7 shows an overall schematic view of a possible machine according to the invention.

FIG. 7 shows an overall view of a possible machine 10 with the processing head 11 provided with the processing device 14 and with the aforementioned movement systems.

All the motorized movements may be controlled by a known electronic control unit 21 in which the trajectories to be followed are programmed, depending on the model and size of shoe being processed, as is well-known to the person skilled in the art. A suitable known man/machine interface, not shown, (for example provided with keyboard and display or touchscreen display) may also be provided.

The general structure of the machine 10 for moving the head and fixing the shoe is per se known and may be easily imagined by the person skilled in the art without further explanations. Other known movement structures may also be used for ensuring that the device follows the desired trajectory on the shoe. For example, a machine provided with an anthropomorphic arm which terminates in said device may be used. It is also possible to envisage a structure in which rotation of the shoe about an axis perpendicular to the sole is not necessary, but where it is the device itself which is displaced completely around the shoe. A portable device which can be manually moved may also be envisaged.

The processing device 14 comprises a roughing tool 22 for performing roughing of the desired part of the surface of the shoe. This roughing tool comprises an operating surface 23, namely a surface (also formed by separate elements arranged next to each other and not necessarily a continuous or compact surface) which operates on the shoe so as to perform roughing thereof.

The roughing tool will be preferably of the type with rapid movement of a peripheral abrasive part which forms the operating surface 23 of the tool. The tool may be for example a roughing head with metal teeth, brush, milling cutter or the like, as may be easily imagined by the person skilled in the art.

For example, it has been found to be advantageous to use a tool composed of a rotating motor-driven disk with a peripheral edge of suitable width which may be for example covered with sandpaper made of abrasive material or formed by sufficiently rigid bristles (for example metal wires) for ensuring a suitable roughing action on the material of the shoe. Also other types of roughing tools, known per se to the person skilled in the art, may in any case be used. For example, the tool may comprise a displaceable abrasive belt.

It has however been found to be preferable for the roughing tool to be of the rotating-brush type with a radial operating surface.

FIGS. 1, 2, 3, 4 and 5 show, for example, roughing tools rotating about a central axis (indicated by 32 in FIG. 1) and having a peripheral, circumferential, operating axis about this axis.

The processing device 14 also comprises means 24 for dispensing a suitable glue for shoes. These means 24 dispense the glue so that it is spread on the operating surface of the roughing tool. The roughing tool will thus convey and transfer the glue onto the shoe in the zone where roughing is also performed.

Typically, in the case of a rotating or displaceable tool, the glue will be advantageously dispensed onto the tool in a zone which is in front of the point or area of contact between tool and shoe.

The dispensing means are for example arranged facing the operating surface of the tool, as shown for example in FIGS. 1, 2, 3 and 4.

As will become clear below, the dispensing means may also for example comprise dispensing devices chosen from emission nozzles, dispensing brushes, dispensing rollers or spray nozzles.

The dispensing means may also be incorporated in the same roughing tool, as will be clarified below.

The dispensing means comprise a glue dispenser suitable for the type of glue used. These means may be for example chosen from among those which per se substantially known for applying glue onto a surface and may also depend on the specific type of glue used. For example, as will become clear below, the dispenser may be a brush or roller making contact with the surface of the tool and suitably supplied automatically with glue, or a sprayer (in the case of a sufficiently liquid glue), etc., as may be easily imagined by the person skilled in the art.

In the configuration described it is important that the glue should not spread into the outer side part of the tool, since this could result in it spilling beyond the roughing area defined. It is therefore useful for the device to incorporate a suitable system which, by means of flanges, brushes or other similar mechanical devices, keeps the glue inside the edges of the roughing tool, eliminating any excess glue before it reaches the shoe.

Advantageously, the device comprises elements for cleaning surfaces of the tool which are adjacent to the operating surface and for removing any glue on these surfaces. For example, as shown in FIG. 1, both sides of the roughing tool may therefore be provided with cleaning elements (for example a suitable knife or brush element) which clean any glue which may spill over laterally from the operating surface of the tool. Only one of these elements, indicated by 25, is visible in FIG. 1, the other element being substantially the same on the other side of the roughing tool.

Figure 2:
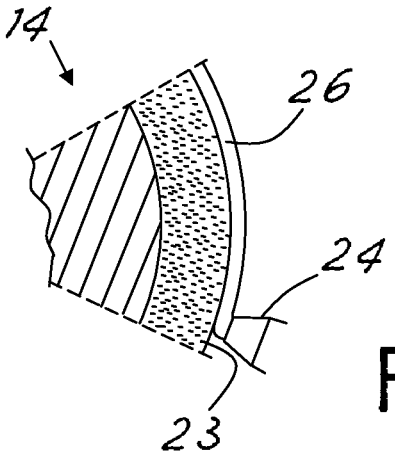
FIGS. 2-6 show partially sectioned and schematic partial views of possible processing devices according to the invention.

FIG. 2 shows in schematic form a possible embodiment of the processing device during operation. This figures shows a cross-section through a segment of the roughing tool (formed for example as a rotating disk) with the dispensing means 24 which spread over the operating surface 23 of the tool a predetermined glue flow which forms a layer of glue 26.

The operating surface 23 may be formed by an abrasive layer or by radial bristles of a suitable roughing brush.

Figure 3:
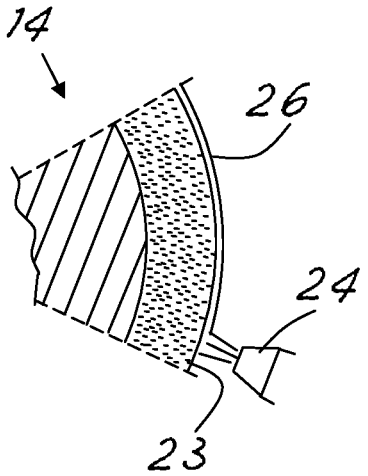
Figure 4:
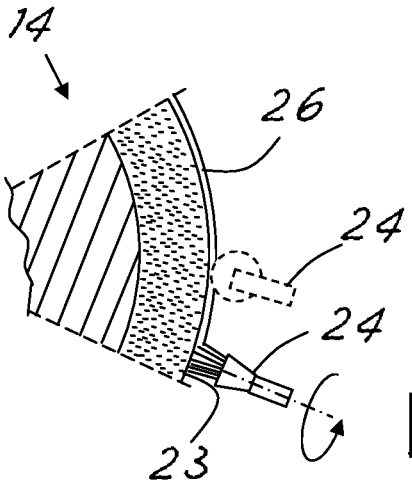

The dispensing means 24 may also be for example a nozzle for spray emission of liquid glue, as shown schematically in FIG. 3, a dispensing brush (which may be axially rotatable), as shown in solid lines in FIG. 4, or also a dispensing roller, as shown again in FIG. 4 in broken lines.

Instead of using an external device for applying the glue onto the carding tool, it is also possible to consider introducing the glue by means of a special circuit inside the roughing tool itself, for example with holes or grooves through which (advantageously by means of the centrifugal force, in the case of a rotating tool, and together with the pressure of the circuit supplying the glue) said glue would pass outside of the roughing tool and then be applied onto the shoe.

Figure 5:
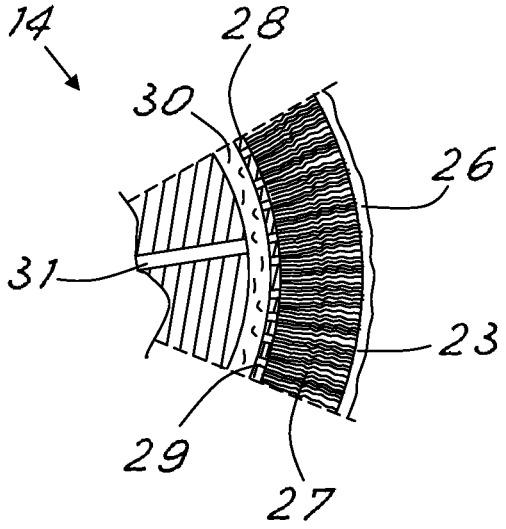

FIG. 5 shows in schematic form a cross-sectioned segment of such a possible alternative embodiment of the device. In this embodiment, the rotating roughing tool is formed, for example, by a disk with a surface 23 formed by radial bristles 27, for example consisting of metal wire.

The surface 28 from which the bristles 27 project is formed with suitable passages 29 through which glue is emitted between the bristles 27 and thus reaches the outer surface 23 in order to form the layer of glue 26.

The glue may be supplied to the passages 29 via suitable channels 30, 31 inside the roughing tool. With the tool rotating, the channels 30, 31 will be connected to the glue source by means of a suitable rotating connector (of the known type and therefore not shown) located on the axis of rotation of the tool.

In the case where the roughing tool is of the type rotating on its own axis so as to operate via its peripheral surface, rotation may be at a speed such that the centrifugal force generated ensures that the glue applied thereon always remains on the surface and is therefore correctly applied onto the shoe.

Figure 6:
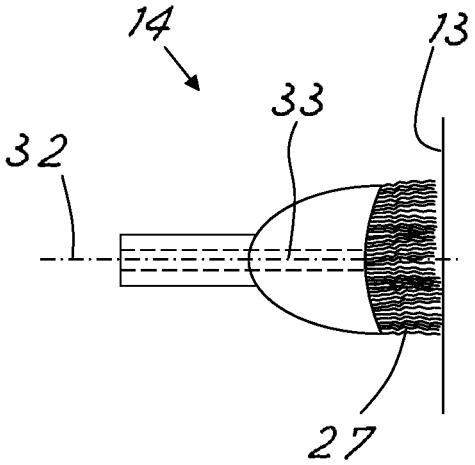

The roughing tool could also be designed to operate frontally, as for example in the case of a rotating brush with hard bristles. In this case the glue would not be pushed onto the brush by the centrifugal force, but by the pressure of the circuit supplying the glue. The device could thus be similar to a normal gluing brush, but provided with bristles (for example made of metal) sufficiently hard to perform roughing of the material of the shoe, instead of soft material. This possibility is shown for example in FIG. 6, where the axis of rotation 32 is perpendicular to the surface of the shoe 13 to be roughed. The internal glue supply channels are indicated by 33. The brush will be designed with a suitably small size at the front for the area to be roughed.

In any case, according to the principles of the invention, during use the operating surface of the roughing tool is brought into contact with the shoe following the predetermined roughing trajectory, while the glue is spread over the operating surface. The surface of the shoe is thus suitably roughed and at the same time has glue spread over it. In this way the glue follows precisely the roughing path.

It has been surprisingly found that this does not hinder the roughing operation, but on the contrary improves penetration of the glue into the roughing surface in the roughed zones, thereby improving the final gluing quality.

Moreover, the presence of the glue on the surface of the roughing tool has the further advantage of retaining on the tool the roughing residues which may be damaging for gluing since they create impurities which may adversely affect the adhesive grip thereof. The particles produced by the roughing action are at most absorbed within the glue and cannot infiltrate between the surface to be glued and the glue.

At this point it is clear how the objects of the invention have been achieved.

According to the roughing method of the invention, in order to rough a part of the surface of a shoe for subsequent gluing, the steps comprise spreading a glue on the operating surface of a roughing tool and then applying this operating surface onto the part of the shoe to be roughed before drying of the glue.

As a result of this method (and the advantageous device implementing it), it is possible for example to concentrate the roughing and glue-spreading operations in a single operation and in a single machine.

The step where the shoe is marked may thus be entirely eliminated (it being possible to use a machine of the type already used for roughing by means of suitable programming of the roughing path) and at the same time it is possible to carry out the roughing and glue-spreading operations on the same machine and with the same tool, so as to ensure with certainty that the roughed part and the glued part tally entirely with each other.

In other words, in the device according to the invention the roughing tool is suitably infused with glue by means of a suitable device (bristle brush, soft brush, sprayer, internal channels, etc.). The roughing tool thus performs the roughing operation following a suitable path defined and programmed in the machine, but at the same time applies the glue onto the roughed part.

With the method according to the invention it is possible to ensure that the roughing and gluing path, followed by the same tool, is clearly the same one. This ensures the maximum precision and correspondence between the two operations. Moreover, in fact, the processing operation is carried out in a single step, therefore halving the time (and cost) necessary for completion thereof.

Since a same machine (with a structure similar to that of a single roughing machine, but with a processing device according to the invention) performs both the roughing and the gluing operations, the final cost of the equipment needed for these operations is also greatly reduced.

Obviously the description above of embodiments applying the innovative principles of the present invention is provided by way of example of these innovative principles and must therefore not be regarded as limiting the scope of the rights claimed herein. During the specific implementation of the characteristic features of the present invention only some of the functions or devices described above may be chosen and combined together or, on the other hand, also other known shoe-processing systems may be combined with the principles of the invention.

The invention claimed is:

1. A device for preparation of a part of a surface of a shoe for subsequent gluing, comprising a roughing tool having an operating surface and glue dispensing means oriented to spread the glue on this operating surface during the operation of roughing said part of the surface of the shoe, so as to transfer directly the glue onto said part of the surface being roughed, wherein a support for the shoe is present and the roughing tool is a tool rotating about a central axis and the operating surface is a peripheral, circumferential, operating surface around this central axis and the dispensing means are arranged facing the operating surface of the roughing tool in a position around the peripheral, circumferential, operating surface so that the glue is spread directly on the operating surface of the rotating roughing tool before the operating surface contacts the surface of the shoe on the support.

2. The device according to claim 1, characterized in that the dispensing means comprise dispensing devices selected from among emission nozzles, dispensing brushes, spray nozzles, and dispensing rollers.

3. The device according to claim 1, characterized in that the dispensing means dispense the glue from the inside of the roughing tool.

4. The device according to claim 1, characterized in that it comprises elements for cleaning surfaces of the tool which are adjacent to the operating surface and for removing glue on these adjacent surfaces.

5. The device according to claim 1, wherein the roughing tool and the dispensing means are in a head which is supported according to a first axis which is transverse to said central axis and driven to be inclined about said first axis with respect to the support for the shoe.

6. The device according to claim 5, wherein the first axis is a horizontal axis.

7. The device according to claim 5, wherein the head is also supported according to a second axis which is vertical and driven to be rotated about said second axis with respect to the support for the shoe.

8. The device according to claim 5, wherein the support is rotatable about a rotation axis and displaceable in a direction transverse to the rotation axis so as to move the shoe on the support underneath the roughing tool.

9. The device according to claim 8, wherein the head is driven to be movable along a vertical axis and along a horizontal axis which is transverse to the rotation axis of the support.

* * * * *